United States Patent [19]

Slinsky

[11] Patent Number: 4,520,599

[45] Date of Patent: Jun. 4, 1985

[54] DRILL BIT SHARPENER

[76] Inventor: Albert Slinsky, 909 Aberdeen Ave., New Port Richey, Fla. 33552

[21] Appl. No.: 466,036

[22] Filed: Feb. 14, 1983

[51] Int. Cl.[3] ..... B24B 3/26

[52] U.S. Cl. ..... 51/219 R

[58] Field of Search ..... 51/55, 219; 76/5 R

[56] References Cited

U.S. PATENT DOCUMENTS

| | | | |
|---|---|---|---|
| 1,195,248 | 8/1916 | Mallory | 51/219 R |
| 2,415,121 | 2/1947 | Wilken | 51/219 R |
| 2,556,073 | 6/1951 | Dixon | 51/219 R |
| 2,580,884 | 1/1952 | Bowman | 51/219 R |
| 2,848,847 | 8/1958 | Casselman | 51/219 R |
| 3,057,122 | 10/1962 | Hewes | 51/219 R |
| 4,270,315 | 6/1981 | Reiling | 51/219 R |

FOREIGN PATENT DOCUMENTS

| | | | |
|---|---|---|---|
| 135810 | 12/1929 | Switzerland | 51/219 R |

*Primary Examiner*—Harold D. Whitehead

*Attorney, Agent, or Firm*—Ronald E. Smith

[57] ABSTRACT

A drill bit sharpening apparatus designed to sharpen the points of bits having differing diameters and differing point angles. The apparatus accommodates bits having differing point angles by providing a bit cradling member that has a plurality of mounting apertures formed therein wherein the respective positions of such apertures are predetermined to position the bit to be sharpened in proper angular relation to the grinding means, such aperture positions being mathematically determined. Bits of differing diameters are accommodated by a mechanism that positions the bit cradling member and hence the bit to be sharpened in the proper spaced relation to such grinding medium, said positioning also being mathematically determined. A different gauge member is provided for each differing point angle, and a plurality of algorhythm-derived points are marked on each gauge, which points represent the respective settings of the apparatus as between bits of differing diameters.

9 Claims, 14 Drawing Figures

DRILL BIT SHARPENER

BACKGROUND OF THE INVENTION

1. Field of the Invention

This invention relates, generally, to devices for sharpening the points of drill bits, and more specifically to such a device that sharpens drill bit points in accordance with specific geometric shape criteria.

2. Description of the Prior Art

A search of U.S. patents that was conducted prior to the filing of this disclosure located the following patents:

| Patentee | U.S. Pat. No. | Date of Issue |
|---|---|---|
| Mitchell | 1,788,682 | 01-13-31 |
| Whipple | 2,426,478 | 08-26-47 |
| Van Wyk | 2,524,279 | 10-03-50 |
| Rochet | 3,626,645 | 12-14-71 |

The field of seaarch included Class/sub-class 51/55, 219, 288, 76/5.

Generally, there are two methods known in the art to accomplish the sharpening of a drill bit point. A good description of such methods can be found in the following publication: "Machinery's Handbook, 1943 edition". More particularly, reference should be made to a section in such handbook entitled "Drill Point Grinding".

The drill bit point sharpener to be disclosed hereinafter is designed to accomplish the geometric shape criteria described in such handbook.

SUMMARY OF THE INVENTION

The longstanding but heretofore unfulfilled need for a drill bit point shapener that accomplishes the aforementioned geometric shape criteria is now provided in the form of an apparatus that is structured such that a conceptual cone is swept out attendant the sharpening procedure.

The apparatus is provided in the form of a portable unit having a base that is fixedly secured to a work surface when the apparatus is to be used. The non-base portions of the apparatus are slidably mounted atop such base and can collectively assume an infinite plurality of functional positions of adjustment relative to the base.

The non-base portions of the apparatus provide a cradle means to hold the drill bit to be sharpened, and further provide a pair of pivoting means that allow such cradling means and hence the drill bit to be pivoted in a horizontal plane, a vertical plane, and combinations thereof, such pivotal movements occuring during the sharpening procedure.

The base portion of the apparatus, the non-base portion thereof, and the drill bit to be pointed are initially collectively aligned so that their respective longitudinal axes of symmetry are parallel to the rotational axis of a rotatably mounted grinding medium. Accordingly, the sharpening procedure involves the orientation of the inventive apparatus at right angles to the rotating circular face of a conventional disc-shaped grinding means. Depending upon the point angle of the drill bit to be sharpened, the spacing between such drill bit point and the grinding surface will vary. The inventive apparatus provides a mechanical means for indicating the correct spacing for a plurality of point angles and for a plurality of drill bits of differing diameters.

The mechanical settings are derived from a mathematical formula disclosed hereinafter.

It is therefore seen to be an important object of this invention to provide an apparatus that will sharpen drill bit points in an optimal manner.

A more specific object of the invention is to provide a drill bit point sharpening apparatus that produces a geometrically correct sweeping action of the drill bit across the face of a grinding means responsive to simple pivoting motions applied to the inventive apparatus.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts through out the several views of the drawings.

DETAILED DESCRIPTION OF THE PREFERRED EMBODIMENT

Figure 1:
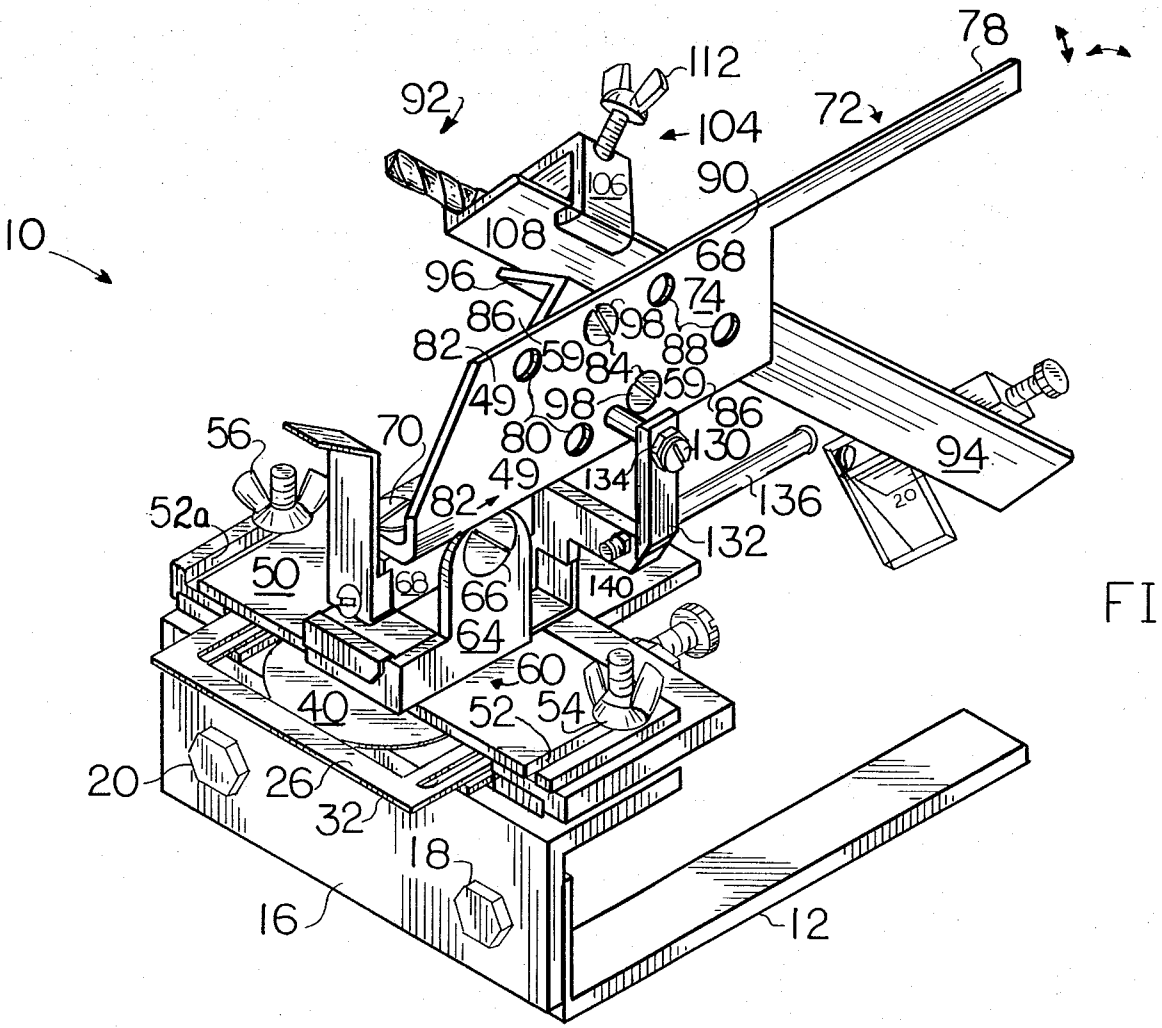
FIG. 1 is a perspective view of an embodiment of the invention that illustrates the inventive concept.

Referring now to FIG. 1, it will there be seen that a drill bit pointer that illustratively embodies the inventive concept is shown in perspective and designated generally by the reference numeral 10.

The pointer 10 includes a base means provided in the form of a pair of flat base elements 12, 14 (see also FIG. 2) that are disposed in parallelism with one another and which are respectively provided with an upwardly turned orthogonal bend in the forward portions thereof as best seen in FIG. 1.

The respective upwardly turned portions of said flat base elements 12, 14 provide a mounting means for the balance of the parts of the illustrative pointer 10. An angle iron means 16 is fixedly secured to such upwardly bent portions as shown, said portions and said angle iron member 16 being cooperatively apertured to accommodate screw means 18, 20. Of course, the base elements 12, 14 and the angle iron member 16 could be provided as an integrally formed structure. It should be understood that the parts described throughout this description can take a number of forms and be assembled in a number of ways, the specific configuration of the pointer 10 being shown and described serving merely as a guide to the understanding of the inventive concept.

Referring now to FIGS. 1, 2, 7, and 8, it will there be seen that spacer or shim means, denoted 22, 24, are provided at opposite ends of the horizontally disposed portion of the angle iron member 16. Intermediate thereof is the assembly that provides a mathematically, i.e., trigonometrically-originated means for determining the proper positioning of a drill bit of a specific diameter to be pointed vis a vis the grinding surface. The assembly includes a rectangular stop member 26 that is slotted to receive nylon screw members 28, 30 so that it can move between a rearwardmost and forwardmost position and an infinite plurality of functional positions of adjustment therebetween attendant loosening of such screws 28, 30.

The stop member 26 slidingly abuts the edges of the shim means 22, 24 along its opposite edges as shown. Thus, it is seen that such shims 22, 24 serve as a guide means for the stop member 26, maintaining the forward edge 32 and the rearward edge 34 (FIG. 7) of such stop member 26 in parallel alignment with the grinding surface. The stop member 26 has a rectangular cut away portion identified generally as 36, which portion 36 includes a forward edge 38 that plays a critical role in the functioning of the pointer 10 as will become clear as this description proceeds.

Figure 7:
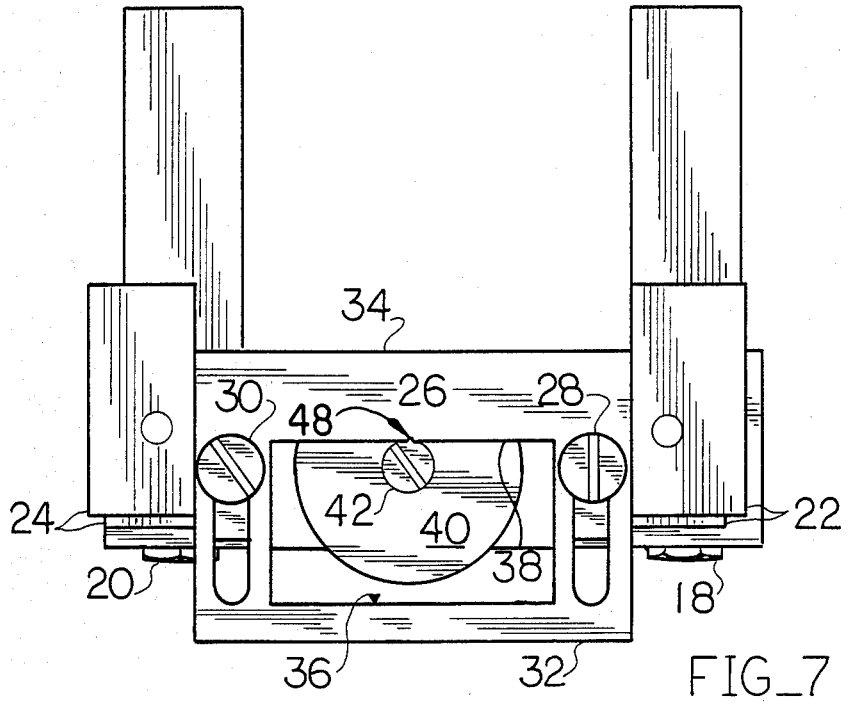
FIG. 7 is a top plan view of the base portion of the inventive assembly.
Figure 8:
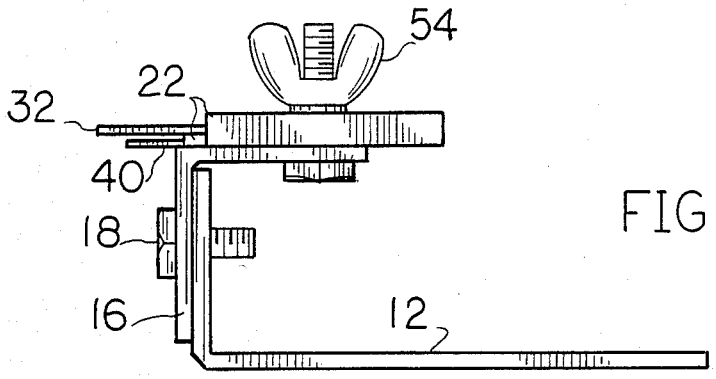
FIG. 8 is a side elevational view of such base assembly.
Figure 9:
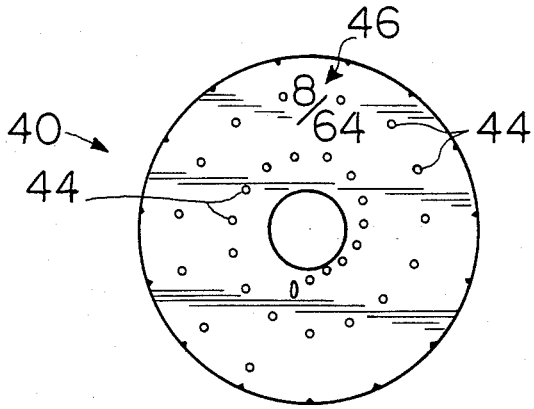
FIG. 9 is a top plan view of a mechanical disc member having a plurality of points marked thereon that embody the points generated by the inventor's formula that determines the correct spacing between the drill bit to be pointed and the grinding medium.

A flat disc member 40 is rotatably mounted as at 42 to the horizontal wall of the angle iron 16, as shown in FIG. 7. FIG. 9 shows that the disc member 40 is provided with perforations 44 or other suitable markings, and that such markings 44 are arranged in a spiral-like configuration. A plurality of indicia means, collectively identified by the reference numeral 46, designate, in this illustrative embodiment, which perforations 44 correspond to cooperative settings of the disc 40 and rectangular stop member 26, in sixty-fourths of an inch (1/64″), for drill bits, to be pointed, of differing diameters. For example, when a drill bit having a quarter inch (¼″) diameter is to be pointed, screw member 42 is loosened and the perforation 44 marked 16/64 will be aligned, i.e., brought into juxtaposition with, a mark 48 (FIG. 7) that is provided mid-length of the rectangular stop member 26 at the forward edge 38 of cut away portion 36. The screw member 42 will then be tightened to maintain the alignment so established. It should be mentioned at this point of the description of the inventive concept that a zero (0) setting of the disc member 40 and the mark 48 must be established before the above-alignment is undertaken. However, a description of how such zero (0) setting is reached must be deferred until the balance of the inventive parts have been described. It is also advantageous to defer the disclosure of how the respective positions of the markings 44 are derived.

Returning now to FIGS. 1 and 2, it will there be seen that a second angle iron member 50 is slideably mounted at its opposite ends atop the respective shim means 22, 24. Such shims 22, 24 are of sufficient vertical dimension to cause the angle iron 50 to bridge the rectangular stop member 26/disc member 40 assembly. The angle iron 50 is provided with forwardly opening slot means **52, 52*a* formed therein, and is accordingly positionable in a plurality of functional positions attendant loosening and tightening of the wing nuts 54, 56. The vertically aligned portion 58 (FIG. 3) of the second angle iron member 50 will abut the rearward edge 34 (FIG. 7) of the stop member 26 when the angle iron member 50 is moved to its forwardmost position. Since the position of the rearward edge 34 of the stop member 26 is determined by alignment of mark 48 and the appropriate indicia 44, as aforesaid, it is thus seen that the positioning of the stop member 26 determines the positioning of the angle iron 50 and thus of the balance of the inventive parts in that the balance of such parts are carried by and move conjointly with such angle iron member 50**.

The balance of the inventive parts are interconnected to the angle iron 50 through a bracket member 60 (FIGS. 1 and 3) that includes a base portion 62 (FIG. 2) fixedly secured by any suitable means to the horizontal portion of angle iron member 50, mid-length thereof as shown. The bracket member 60 includes a vertically disposed wall portion 64 that is apertured to receive a nylon screw member 66, or any other suitable pivot point-defining element. The screw member 66 impales a square-in transverse section pivot member 68 that is advantageously provided in the form of a one-half inch (½″) key stock. Thus, the pivot member 68 is free to pivot in a vertical plane.

Figure 2:
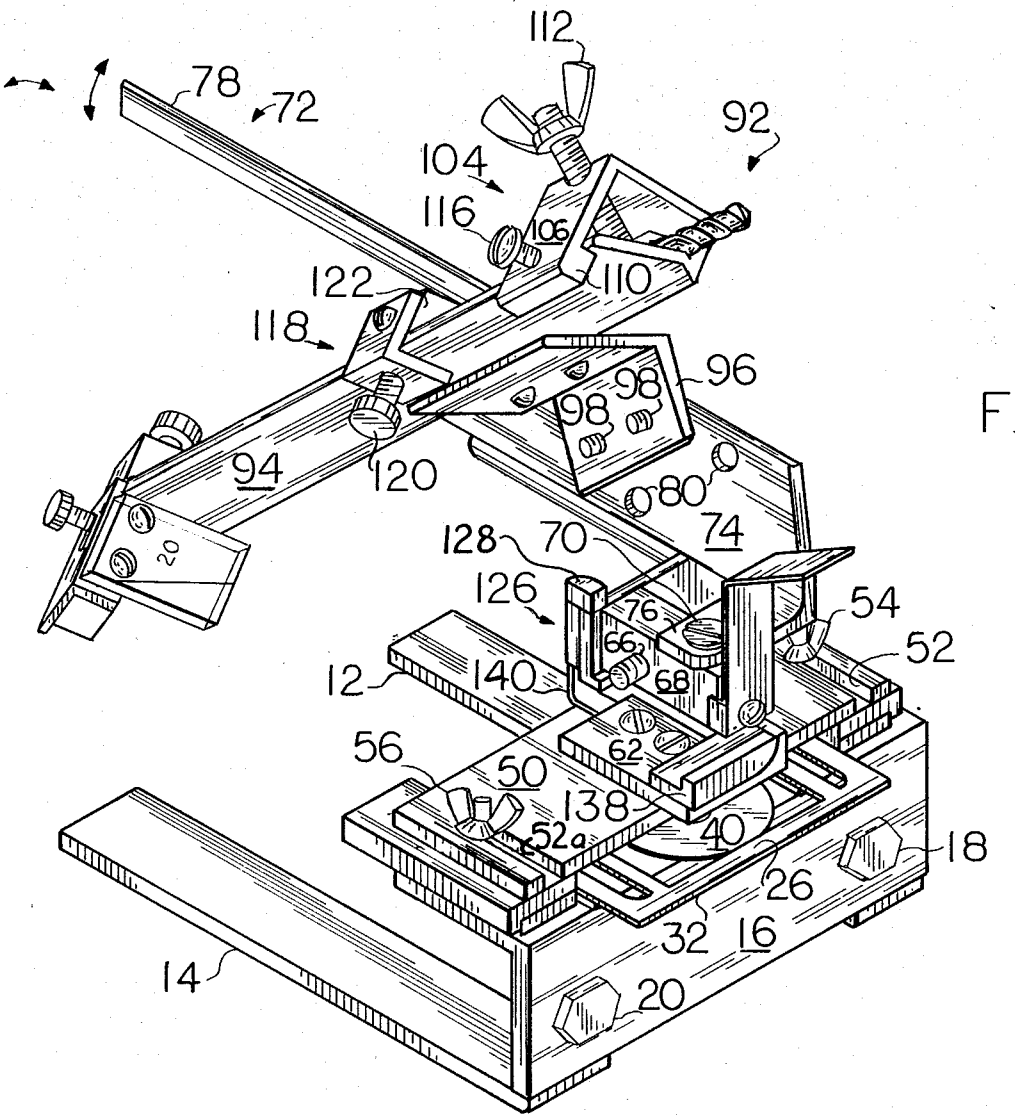
FIG. 2 is a perspective view of such embodiment, showing the opposite side thereof.

Another nylon screw member 70, or other suitable pivot point-defining means, impales the pivot member 68 at its forward portion as shown, and provides pivotal motion in a horizontal plane of an elongate handle member 72. The body 74 of the handle 72 is oriented in a vertical plane and is connected to the pivot point 70 at its forwardmost portion 76 which is bent to lie in a horizontal plane to achieve the pivotal mounting at 70 (FIG. 2).

Accordingly, the handle member 72 is movable in a vertical plane and in a horizontal plane. As will become clear as this description proceeds, the sharpening, or pointing, process begins with the handle 72 lying in a horizontal plane, and such handle is pivoted about pivot point 66, i.e., the distal end 78 of handle 72 is raised, as the sharpening procedure is carried out. The pointing process also involves lateral motion of such distal end 78 as the point of the drill bit is swept across the face of the grinding means, such sweeping motion constituting a pivoting of the handle 72 about pivot point 70.

It should now be observed that the forward portion of the handle 72 is provided with three (3) pairs of apertures. The forwardmost pair of apertures, collectively designated 80, are identified by indicia 82 as being associated with drill bits having a point angle of ninety eight (98) degrees. Similarly, the next two (2) pairs of apertures 84, 88, are identified by indicia 86, 90 as being associated with drills having point angles of one hundred eighteen (118) and one hundred thirty six (136) degrees, respectively. The different angular alignment of the apertures 80, 84 and 88 is noteworthy. In view of the teachings of this invention, it is clear that additional pairs of angularly oriented apertures can be provided for drill bits having other point angles, and the invention is thus not limited to the specific pairs of apertures and corresponding point angles that are specifically shown and described herein.

The drill bit to be pointed, indicated as 92 in the drawings, is cradled in another angle iron member 94, and such drill bit-supporting angle iron member 94 is in turn fixedly secured to still another angle iron member 96 which is removably and selectively mounted by screw means 98 to the handle 72 at apertures 80, 84, or 88, dependant upon the point angle of the bit 92 to be pointed.

Having thus described the primary components of the inventive structure 10, the procedure to be followed in pointing a drill bit will now be described.

Figure 5:
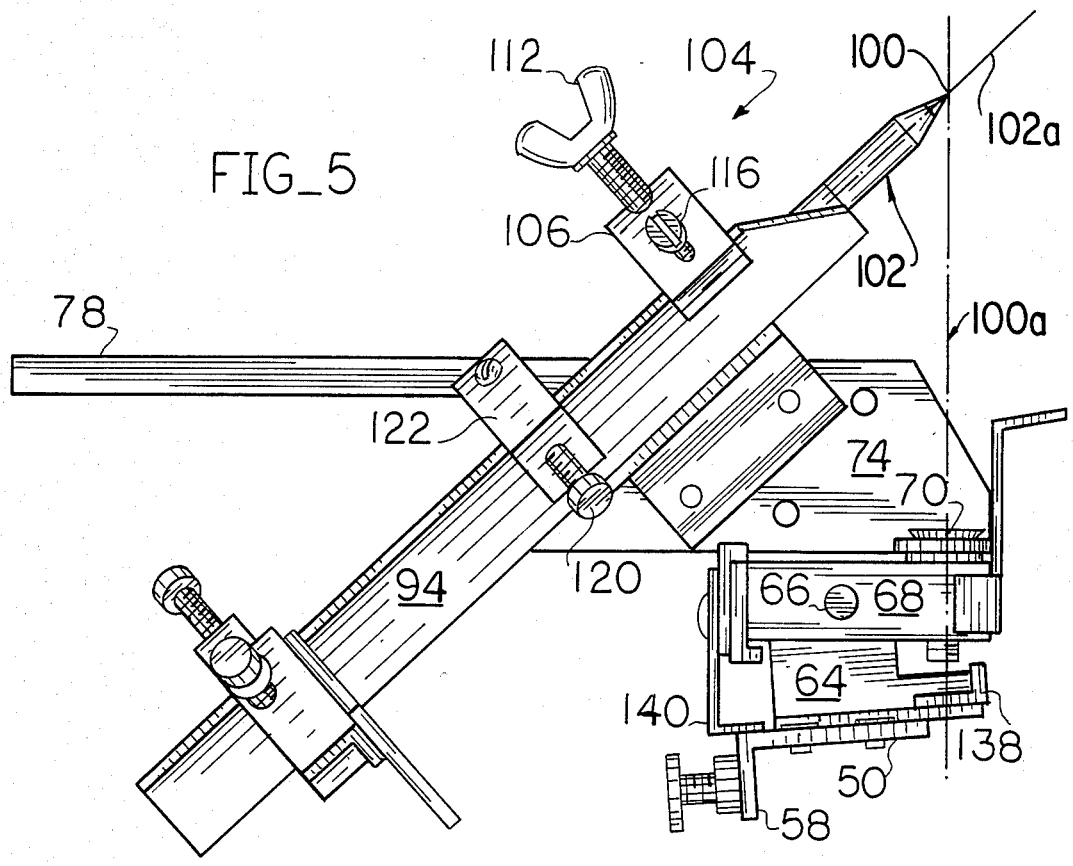
FIG. 5 is a view similar to FIG. 3, showing the opposite side of such assembly.
Figure 6:
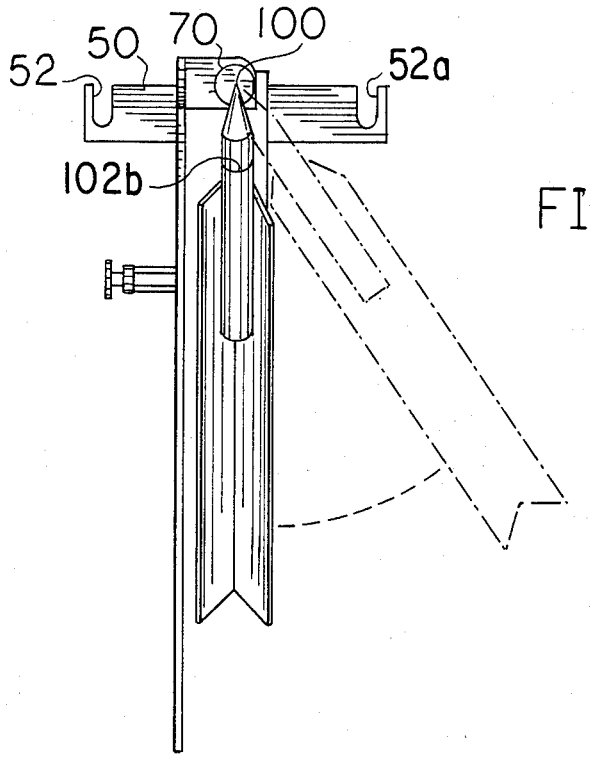
FIG. 6 is a view somewhat similar to that of FIG. 4, showing the extreme positions that may be assumed by such cradling means in the course of the sharpening process.

A zero (0) setting for the disc 40/stop member 26 assembly must first be provided, as mentioned earlier in this description. Initially, the disc 40 is rotated until the zero (0) perforation 46 aligns with mark 48, in the manner above detailed. (Refer again to FIG. 7). An imaginary vertical line 100*a*, as shown in FIG. 5, must then be drawn coincident with the vertical axis of symmetry of pivot point 70. (See also FIG. 6). In practice, the intersection of such imaginary vertical line 100*a* with axis 102*a* at point 100 is represented in physical form by rod member 102 that is machined to a center point. A transverse score mark 102*b*, for later reference, is then placed on the rod 102 where it overhangs the forwardmost edge of angle iron member 94. The transverse score mark serves as the zero (0) setting for rod 102. With the disc assembly 26, 40 and rod 102 cooperatively set at zero (0), the non-base portion (FIG. 3) is slideably mounted to the base portion (FIG. 7) by slot means 52, 52*a* and wing nut 54, 56. The pointer 10 is now in its zero (0) setting. The angle means 16 is permanently secured to the grinding wheel structure, so as to permit the point 100 to lie within the plane of the grinding surface. This alignment procedure need be performed only once.

Having properly placed the inventive pointer 10 into its zero (0) setting, a bit 92 to be pointed is placed in angle iron member 94 and positioned as follows. Initially, the correct circular gauge (disc member 40) is selected and properly positioned in the pointer 10 (a different circular gauge 40 is provided for each angular setting (apertures 80,84,88) of drill bits to be sharpened, since the respective positions of the markings 44 will differ between drill bits of differing angular settings, as will be made clear when the formula for determining the respective positions of such markings 44 on the respective disc 40 is disclosed hereinafter).

Figure 10:
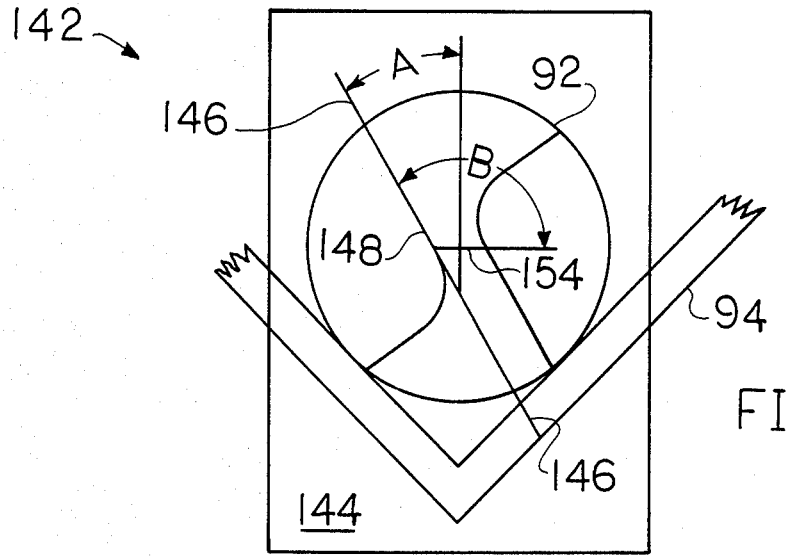
FIG. 10 is a front elevation view of a transparent screen member that is employed to assure symmetrical grinding of the drill bit.

The bit 92 to be sharpened is then placed into its cradle means, angle iron member 94, and the member 94 is pivoted in its vertical plane about pivot point 66 until the cradle means 94 is in its forwardmost (lowermost) position. The bit 92 is then slid forwardly until its point contacts the grinding wheel. The cradling means 94 is then returned to its uppermost (rearwardmost) position, and the bit 92 is slid forwardly a small amount as suggested in FIG. 3. A gauge member 142, shown in FIG. 10, is then attached by suitable means to the angle iron member 94, and a cutting edge 148 of the bit 92 is aligned (by rotating the bit 92 about its longitudinal axis of symmetry) with the scribe mark 146 that is provided on transparent screen 144. Upon removal of such gauge 142, the grinding process is ready to commence once the bit 92 is secured into the position achieved by following the above-described procedure.

Figure 4:
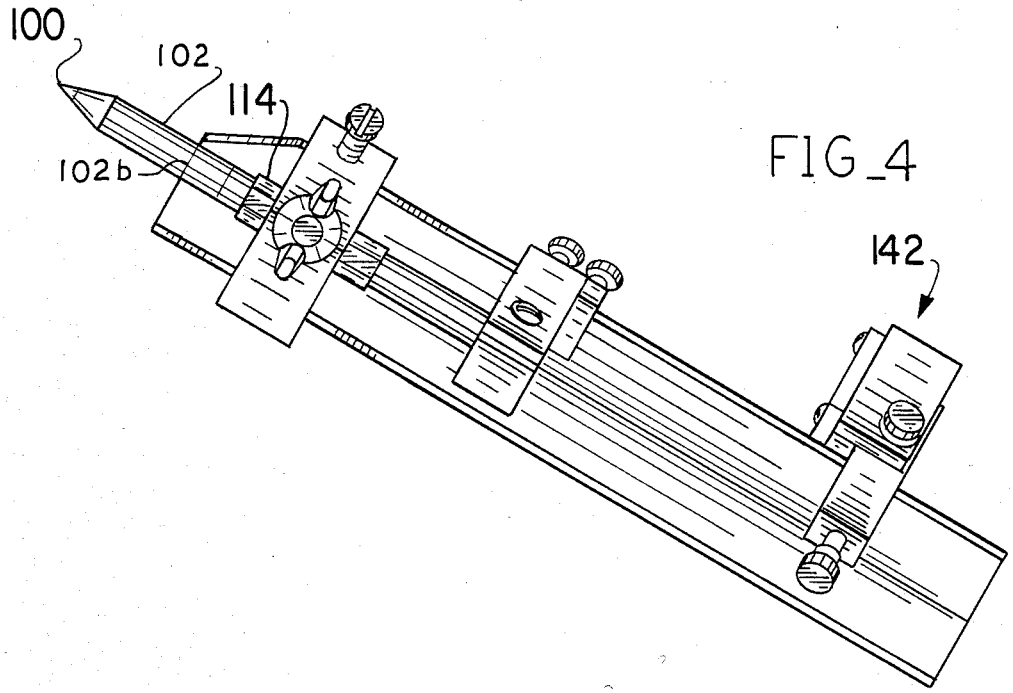
FIG. 4 is a top plan view of the drill bit cradling means of the invention.

The bit 92 is clamped into such correct position by a clamping assembly designated 104 as a whole, which assembly 104 includes angle member 106 having gripping pads 108, 110, screw means/wing nut assembly 112 that extends through an internally threaded aperture formed in the central portion of the angle member 106, at its vertex, and which is screw threadedly engaged at its distal end to an elongate bit holding means 114. The holding means 114 (FIG. 4). has an angled bottom surface so that a downwardly directed wedging-like action is imparted to the drill bit 92 attendant tightening of the screw/wing nut assembly 112. A nylon screw 116 (FIG. 2) extends through an internally threaded aperture formed coincident with an edge of the angle iron member 94 so that the screw/wing nut assembly 112 can be loosened—thereby allowing movement of the bit 92—when such screw 116 is advanced, screw 116 then serving to maintain the position of the assembly 112.

The same function is also provided by the assembly 118 which includes a screw means 120 and a body portion 122 that engages a sidewall of the angle iron 94 as shown, it being understood of course that advancing the screw 120 holds the assembly 118 in its position which is of course rearwardly of the clamping assembly 104.

A similar assembly 124 performs a drill bit anti-slide function by being clamped to a sidewall of the angle iron 94 as shown.

With the drill bit 92 properly positioned and clamped into position by clamping assemblies 104 and 118, and with the angle iron 94 mounted with the appropriate point angle apertures 80, 84 or 88 through angle iron 96 as aforesaid, the bit 92 is ready to be pointed by lifting handle 72 in a vertical plane while sweeping such handle in lateral planes as indicated by the double-headed directional arrows in FIGS. 1 and 2. The lateral sweeping action of handle 72 is limited by a sweep-limiting assembly 126 that is fixedly secured to the rearmost end of the pivot member 68 and positioned in a horizontal plane. A first limiting means 128 is fixedly secured or integrally formed at one end of the assembly 126, and includes a beveled edge that abuts the body portion 74 of the handle 72 to thereby limit the travel of the handle 72 in that direction. The sweep of the handle 72 in the other direction is adjustably limited by nylon screw 130 (FIG. 1), attendant axial travel thereof, such screw 130 extending through internally threaded bracket 132 and locking nut 134.

Screw 130 is axially adjustable to assure pivoting of the cradle means in a plane perpendicular to the plane of the grinding wheel. The initial contact is the beginning of the lateral sweep or pivoting of the cradle in a counterclockwise direction about pivot member 70. Any plane other than a perpendicular plane will result in the relief angle deviating from its desired value as set by the cross hair gauge 142 described hereinafter. Another handle means 136 is mounted as shown to extend rearwardly from the limiting assembly 126, as it has been found in tests of the inventive pointer 10 that such a handle 136 facilitates the desired pivoting about pivot point 66. The pivoting about point 66 is limited by bracket members 138 and 140, the former being positioned forwardly of the base portion 62 of bracket 60, and the latter depending to the rearmost end of pivot member 68. Bracket member 138 plays a key role by stopping the forward pivotal movement at a position where the lateral swing takes place about the axis of a conceptual cone. (The theory behind the use of a conceptual cone is set forth in the above-referred to handbook and in more recent editions thereof and in similar publications). The axis of the screw member 70 is coincident with the axis of the conceptual cone.

The sharpening procedure is more fully detailed as follows: with the bit 92 properly positioned as aforesaid, the angle iron member 94 is pivoted forwardly until the point of the drill bit 92 contacts the rotating side wall of the grinding wheel. The point of the bit 92 is then swept or pivoted across the face of the grinding wheel, such sweeping action occuring in a horizontal plane. This sweeping action is repeated until the angle member 94 has reached its forwardmost (lowermost) position. The bit, at such time, has been correctly ground on one (1) surface. The bit is next rotated one hundred eighty (180) degrees, which proper rotation is ensured by the use of gauge 142 (FIG. 10, as above-mentioned), and the forward-pivoting, across the face-pivoting process is repeated. The bit 92 is then correctly ground for surface geometry and symmetry. In practice, the bit 92 is alternately ground a slight amount on one (1) side and then a slight amount on the other side, until angle iron member 94 reaches its forwardmost position for both the initial setting and the one hundred eighty (180) degree rotational setting. If a complete new surface has not been revealed on both sides of the drill bit point, the drill bit is advanced a slight amount vis a vis its cradle member 94, and the procedure is repeated. Symmetry and correct surface geometry are accomplished when a complete new surface has been revealed on both sides of the drill bit point and angle iron member 94 has reached its forwardmost position after the bit has been ground in both its initial and rotational settings.

Figure 11:
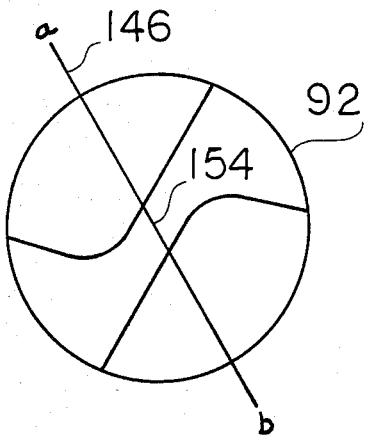
FIG. 11 is a diagrammatical view showing a score line on the screen of FIG. 10 in registration with the chisel edge of a drill bit.
Figure 12:
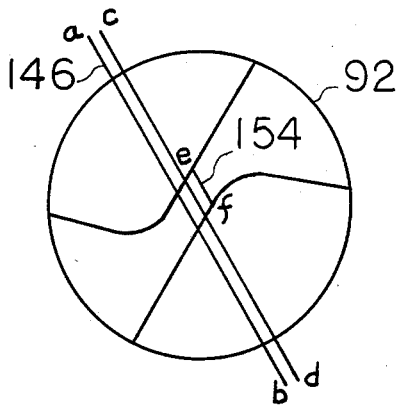
FIG. 12 is a diagrammatic representation of a drill bit that has been asymmetrically ground.

The gauge member 142, mentioned above, is shown in FIG. 10, as aforesaid. The gauge member 142 includes a transparent screen member 144 having a scribe mark 146 provided thereon. As shown in FIG. 10, a cutting edge 148 of a drill bit 92 is in alignment with the scribe mark 146. Thus, a scribe mark angle A is defined as shown, which angle is preferably twenty (20) degrees. A chisel edge angle B is also thereby defined, between chisel edge 154 and the scribe mark 146. When the chisel edge 154 is brought into alignment with the scribe mark 146 as shown in FIG. 11, the drill is seen to be symmetrically pointed. However, when the chisel edge 154 is mis-aligned with the scribe mark 146 as shown in FIG. 12, it is clear that the point has been asymmetrically ground. Coincidence of the chisel edge 154 and the scribe mark 146 in both rotational positions is the goal to be achieved in that such dual position coincidence indicates a symmetrical grinding. Thus, if an absence of symmetry is indicated after the above-described grinding procedure has been followed, the appropriate cutting edge 148 of the bit to be sharpened must be re-aligned with the scribe mark 146, as was done initially, and the process must be repeated. (The "appropriate" cutting edge is of course the edge on the side of the bit in need of further grinding).

Figure 13:
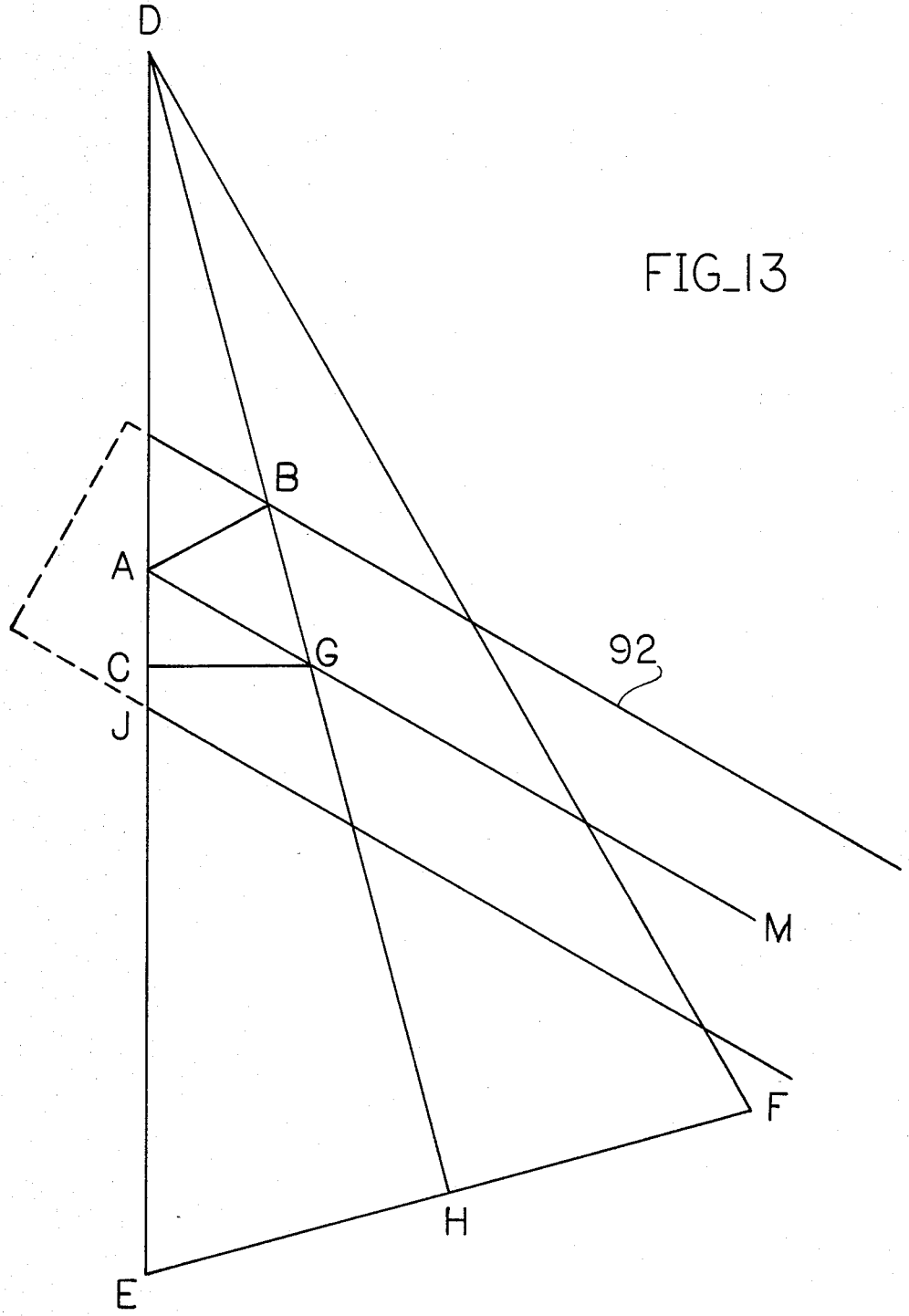
FIG. 13 illustrates a conceptual cone having a longitudinal axis of symmetry that intersects the longitudinal axis of symmetry of a drill bit to be pointed, said point of intersection being optimally set through proper use of the disc member shown in FIG. 9.

It should be clear from the above that spacing disc 40 (there being as many spacing discs as there are angular settings of drill bits) plays a highly critical role in the inventive construction. The disc, as has been shown, is employed to establish the correct spacing between the drill bit to be pointed and the grinding surface. FIG. 13 shows the grinding surface represented by a line D-E, the drill bit 92 having a longitudinal axis of symmetry A-M, and a conceptual cone E-D-F having a longitudinal axis of symmetry D-H. The intersection of axes A-M and D-H is denoted by the letter G, and the shortest distance between such point of intersection G and the grinding surface DE is represented by straight line C-G. It is the distance represented by line C-G that is determined when a preselected perforation 44 on the spacing disc 40 and mark 48 are aligned in the manner aforesaid.

For any diameter drill bit, the respective positions of the markings or perforations 44 thereon are determined by the following formula which has been derived by the inventor herein, where Z is the distance from the center of the gauge 40 to each point 44:

$$Z = C + \cos(90 - B)\left(\frac{R}{\tan B} + \frac{R}{\tan(B - A)}\right) - \frac{(R(1) - R)\sin A}{\sin 45^\circ \sin(B - A)}$$

where $A = \frac{1}{2}$ Helix Angle; $B = \frac{1}{2}$ Point Angle; R = radius of drill bit; R(1) = radius of zero (0) point gauge; and C = Constant. (A prototype of the invention employs C = 0.180, a radius of the zero (0) gauge of 0.125, and a Helix Angle of twenty eight (28) degrees—A = 14 degrees—for example).

Thus, the value of Z, for drill bits having a one hundred eighteen (118) degree point angle, and of the following diameters, is as follows (diameter of bit-value of Z): 1/16–0.178; 5/64–0.192; 3/32–0.206; 7/64–0.221; $\frac{1}{8}$–0.236; 9/64–0.250; 5/32–0.264; 11/64–0.278; 3/16–0.294; 13/64–0.308; 7/32–0.322; 15/64–0.337; $\frac{1}{4}$–0.351.

The value of Z, for drill bits having a eighty (80) degree point angle and of the following diameters, is as follows (diameter of bit-value of Z): 1/16–0.173; 5/64–0.194; 3/32–0.217; 7/64–0.239; $\frac{1}{8}$–0.261; 9/64–0.284; 5/32–0.306; 11/64–0.329; 3/16–0.351; 13/64–0.373; 7/32–0.396; 15/64–0.418; $\frac{1}{4}$–0.440.

The value of Z, for drill bits having a ninety eight (98) degree angle, and of the following diameters, is as follows (diameter of bit-value of Z): 1/16–0.178; 5/64–0.196; 3/32–0.215; 7/64–0.233; $\frac{1}{8}$–0.251; 9/64–0.269; 5/32–0.287; 11/64–0.305; 3/16–0.324; 13/64–0.342; 7/32–0.360; 15/64–0.378; $\frac{1}{4}$–0.397.

The value of Z, for drill bits having a one hundred thirty six (136) degree angle, and of the following diameters, is as follows (diameter of bit-value of Z): 1/16–0.173; 5/64–0.185; 3/32–0.196; 7/64–0.207; $\frac{1}{8}$–0.219; 9/64–0.231; 5/32–0.242; 11/64–0.254; 3/16–0.265; 13/64–0.277; 7/32–0.288; 15/64–0.300; $\frac{1}{4}$–0.311.

Figure 14:
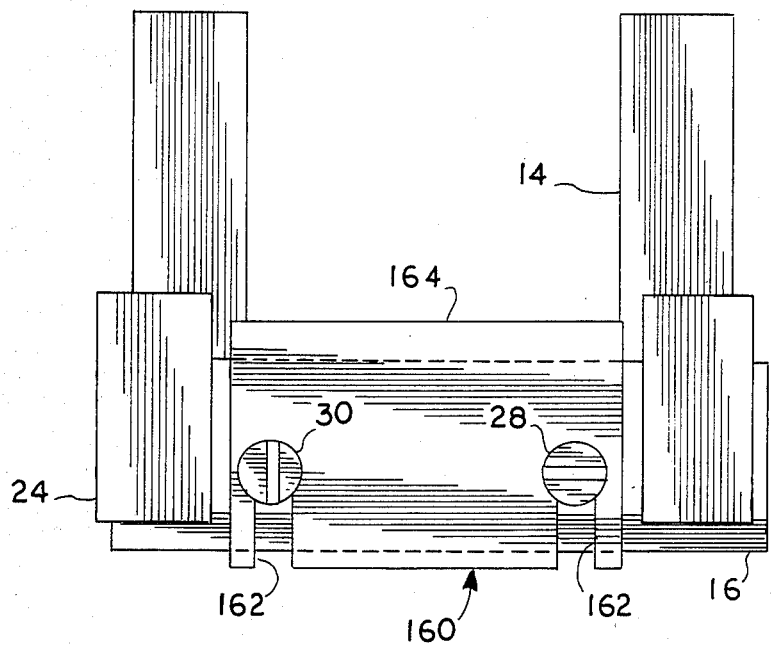
FIG. 14 is a top plan view of the base portion of an alternative embodiment of the invention.

FIG. 14 shows an alternative embodiment the operation of which is the equivalent to the operation of the embodiment above described. In this embodiment, the circular disc or gauge 40 and rectangular stop member 26 are replaced by the flat, rectangular bit positioning member designated 160 as a whole. The member 160 is slotted as at 162, 162 to slidingly receive the screw members 28,30 as shown, and includes a critical trailing edge portion 164. For each point angle, there is provided a set of bit positioning members 160 wherein the number of members in each set is equal to the number of perforations 44 in the circular guage or disc 40. Accordingly, the need to align a given perforation 44 with marking 48 on trailing edge 36 of stop member 26 is obviated as the operator of the novel apparatus need only fully insert a properly selected bit positioning member 160 into the position shown in FIG. 14, i.e., the member 160 is placed in its forwardmost position, and the position of trailing edge 164 will correctly position the bit as desired.

Figure 3:
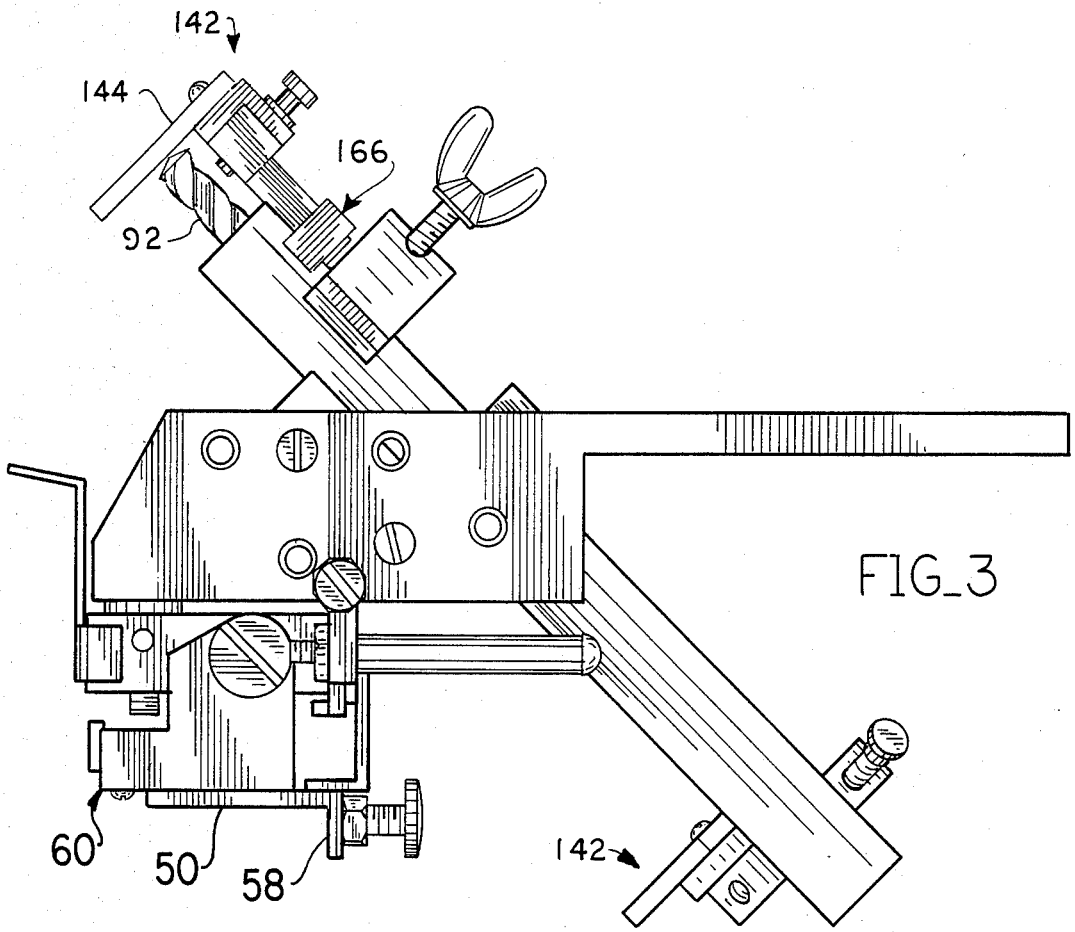
FIG. 3 is a side elevation view of the non-base portions of the inventive assembly.

It will be observed that the screen apparatus 142 used to check the symmetry of the grind is shown in its storage position in FIGS. 1–5, and in its operative position in FIG. 3 (where a spare screen 142 is also shown in a preferred storage position). When in use, the screen 142 is mounted to angle iron 94 by a suitable mechanism 166 that maintains the screen 144 in the operative position shown in such FIG. 3.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. An apparatus for sharpening a drill bit on a grinding means, comprising, a cradle means for holding the drill bit to be sharpened, a cradle means holder that holds said cradle means in a predetermined angular orientation corresponding to the point angle of the drill bit held by said cradle means, said cradle means mounted for pivotal movement in a horizontal plane and in a vertical plane, a support means for supporting said cradle means holder, said support means being selectively moveable away from or toward said grinding means along a line normal to the plane of said grinding means, but said support means not moving during the sharpening procedure, said support means having a downwardly turned trailing edge, a support means forwardmost position indicator that indicates the optimal forwardmost position of said support means and hence of said drill bit to be sharpened for a given drill bit diameter, said indicator being disposed downwardly of said support means, in close proximity therewith, and said support means being slideable along said line with respect to said indicator, said indicator including a rotatably mounted circular disc member, said indicator further including a flat, generally rectangular, slideably mounted stop member, said stop member having a generally rectangular aperture means formed therein, said disc member and said stop member being cooperatively positioned relative to one another so that said stop member overlies said disc member, said aperture formed in said stop member permitting said disc member to be seen by the operator of said apparatus, a plurality of visually ascertainable markings provided on said disc member, whereby the forwardmost position of said support means for a given drill bit point angle is determined when said disc member is rotated to a preselected position, when said stop member is positioned relative to said disc member in a preselected position dependent upon the location of one of said markings, and when said support means is slid toward said grinding wheel until its downwardly turned trailing edge abuts said stop member.

2. The apparatus of claim 1, further comprising, a transparent screen member detachably secured to said cradle means, said transparent screen member disposed in axial alignment with said drill bit and spaced forwardly thereof, said transparent screen member having a score line formed thereon.

3. The apparatus of claim 2, further comprising a drill bit clamping means that maintains said drill bit in a first rotational position when a first surface of said drill bit is being ground, and said drill bit clamping means maintaining said drill bit in a second rotational position that is angularly disposed one hundred eight (180) degrees from said first rotational position so that said drill bit clamping means maintains said drill bit in said second rotational position when a second surface of said drill bit is being ground.

4. The apparatus of claim 3, wherein the score line on said transparent screen member aligns with a chisel edge formed at the point of said drill bit means when said drill bit is in its first rotational position and when said drill bit is in its second rotational position, said alignment of said score mark and said chisel edge in both rotational positions of said drill bit indicating a symmetrical grinding of said drill bit point.

5. The apparatus of claim 1, wherein said cradle means holder is fixedly secured to a handle means so that grinding of a symmetrical drill bit point is accomplished by oscillating said handle means in a horizontal plane, followed by additional oscillations of said handle means in a plurality of successively vertically spaced planes disposed in angular relation to one another.

6. The apparatus of claim 1 further comprising an axially adjustable limiting means that allows the cradle means to pivot in a first angular direction without restriction attributable to said limiting means but which limits the maximum amount of pivotal movement that said cradle means can undergo in an opposite angular direction to a plane perpendicular to the plane of the grinding means.

7. The apparatus of claim 1, further comprising a bracket member disposed downwardly of said cradle holder means that defines the maximum amount of forward pivoting that said cradle holder means may undergo so that the proper lateral sweep of the cradle holder means takes place, which proper sweep is about the axis of a conceptual cone, said axis being physically represented by the point about which said cradle holder pivots when said sweeping action is undertaken.

8. The apparatus of claim 1, wherein the specific position of each marking on said disc member is preselected to properly position said support means for differing diameters of drill bits to be pointed so that a single disc member may store information that indicates the proper positioning of the support means for a plurality of drill bits of differing diameters.

9. The apparatus of claim 8, wherein the markings on said disc member are spirally arrayed.

* * * * *